US010801781B2

(12) United States Patent
Dziubinschi et al.

(10) Patent No.: US 10,801,781 B2
(45) Date of Patent: Oct. 13, 2020

(54) COMPLIANT B-TUBE FOR RADIATOR APPLICATIONS

(71) Applicant: Hanon Systems, Daejeon (KR)

(72) Inventors: Orest Alexandru Dziubinschi, Dearborn, MI (US); Brennan Sicks, Farmington Hills, MI (US); James Smitterberg, Grass Lake, MI (US); Greg Whitlow, Posen, MI (US)

(73) Assignee: HANON SYSTEMS, Daejeon (KR)

( * ) Notice: Subject to any disclaimer, the term of this patent is extended or adjusted under 35 U.S.C. 154(b) by 108 days.

(21) Appl. No.: 16/162,773

(22) Filed: Oct. 17, 2018

(65) Prior Publication Data

US 2020/0124350 A1 Apr. 23, 2020

(51) Int. Cl.

| | |
|---|---|
| ***F28D 1/03*** | (2006.01) |
| ***B21C 37/15*** | (2006.01) |
| ***F28F 1/02*** | (2006.01) |

(52) U.S. Cl.

CPC ..... *F28D 1/0391* (2013.01); *B21C 37/151* (2013.01); *B21C 37/155* (2013.01); *F28F 1/022* (2013.01)

(58) Field of Classification Search

CPC ..... F28F 1/022; F28F 1/04; F28F 1/40; F28F 13/02; F28F 13/12; F28F 2250/04; B21C 37/155; B21C 37/157; B21C 37/151; F28D 1/0358; F28D 1/0391; F28D 1/05358

See application file for complete search history.

(56) References Cited

U.S. PATENT DOCUMENTS

| | | | | | |
|---|---|---|---|---|---|
| 1,056,373 | A * | 3/1913 | Segelken | F22B 7/20 | 138/38 |
| 2,691,991 | A * | 10/1954 | Schutt | F28F 13/12 | 138/38 |
| 3,769,959 | A * | 11/1973 | Parker | A47J 37/1247 | 126/91 R |
| 4,715,432 | A * | 12/1987 | Paikert | F28D 1/0391 | 138/40 |
| 4,729,428 | A * | 3/1988 | Yasutake | F28D 9/0062 | 165/153 |
| 5,441,106 | A * | 8/1995 | Yukitake | F28D 1/0391 | 165/177 |

(Continued)

FOREIGN PATENT DOCUMENTS

| | | | |
|---|---|---|---|
| JP | H10153393 | A | 6/1998 |
| JP | 2002228369 | A | 8/2002 |

(Continued)

*Primary Examiner* — Jianying C Atkisson
*Assistant Examiner* — Jose O Class-Quinones
(74) *Attorney, Agent, or Firm* — Shumaker, Loop & Kendrick, LLP; James D. Miller

(57) ABSTRACT

A tube for use in a heat exchanger including a base portion, an upper portion spaced from and opposing the base portion, and a partitioning wall extending between the base portion and the upper portion to divide a hollow interior of the tube into a first flow channel and a second flow channel. The partitioning wall includes a plurality of windows spaced from each other in a longitudinal direction of the tube to provide fluid communication between the first flow channel and the second flow channel. At least one of the windows includes a tabbed portion of the partitioning wall bent to extend into one of the first flow channel or the second flow channel.

18 Claims, 7 Drawing Sheets

(56) References Cited

U.S. PATENT DOCUMENTS

| | | | | |
|---|---|---|---|---|
| 5,579,837 | A | 12/1996 | Yu et al. | |
| 5,762,133 | A | 6/1998 | Dion | |
| 5,956,846 | A * | 9/1999 | Ross | F28D 1/0391 165/153 |
| 6,247,529 | B1 * | 6/2001 | Shimizu | F28F 1/022 165/177 |
| 6,286,465 | B1 * | 9/2001 | Hughes | F23M 9/003 122/155.2 |
| 6,325,141 | B2 * | 12/2001 | Yamauchi | B21C 37/151 165/177 |
| 6,422,179 | B2 * | 7/2002 | Hughes | F23M 9/003 122/155.2 |
| 6,594,897 | B2 * | 7/2003 | Kim | B23P 15/26 165/177 |
| 6,622,785 | B2 * | 9/2003 | Haegele | F28D 1/0391 138/38 |
| 2002/0005281 | A1 * | 1/2002 | Krupa | F28D 1/0391 165/177 |
| 2002/0017372 | A1 * | 2/2002 | Yano | B21C 23/10 164/113 |
| 2002/0066553 | A1 * | 6/2002 | Fischer | F28D 1/05391 165/174 |
| 2014/0196877 | A1 | 7/2014 | Wilkins et al. | |
| 2016/0018167 | A1 | 1/2016 | Dziubinschi et al. | |
| 2018/0106556 | A1 | 4/2018 | Dziubinschi et al. | |

FOREIGN PATENT DOCUMENTS

| | | | |
|---|---|---|---|
| JP | 2006234267 | A | 9/2006 |
| JP | 2012193950 | A | 10/2012 |

* cited by examiner

COMPLIANT B-TUBE FOR RADIATOR APPLICATIONS

FIELD OF THE INVENTION

The invention relates to a heat exchanger, and more specifically, to a heat exchanger including a B-shaped flat tube having a central partitioning wall with improved compliancy.

BACKGROUND OF THE INVENTION

Heat exchangers having folded flat tubes are well known in the art. Such heat exchangers typically include a plurality of the folded flat tubes spaced apart and arranged in parallel and extending between an inlet header tank and an outlet header tank. The inlet header tank receives a first fluid and distributes the first fluid between a plurality of flow channels formed within the flat tubes. The first fluid exchanges heat energy with a second fluid flowing through the spaces between adjacent ones of the flat tubes. After exchanging the heat energy within the flat tubes, the first fluid is recombined within the outlet header tank before exiting the heat exchanger.

One common construction of a flat tube includes folding a sheet of metallic material such as aluminum into a tubular structure wherein two opposing edges of the sheet are brought together and then brazed or welded at the resulting seam to form a substantially B-shaped flat tube. The central seam of the B-shaped flat tube is typically further reinforced by adding at least one fold to the opposing edges of the sheet. The folded over portions of the sheet of aluminum are positioned to abut an inner surface of the flat tube along a length thereof to form a longitudinally extending partitioning wall, wherein the partitioning wall divides a hollow interior of each of the flat tubes into two separate flow channels while also structurally reinforcing the flat tube along the central seam thereof. This type of flat tube construction is disclosed in U.S. Pat. No. 5,579,837 to Yu et al., which is hereby incorporated by reference in its entirety.

One potential issue faced by the traditional B-shaped flat tube construction occurs as a result of the effects of thermal cycling. The repeated presence of varying characteristics within different portions of each of the tubes, such as varying temperatures experienced in different regions of each of the tubes, may lead to the formation of a bending moment within each of the tubes. The bending moment may, for example, be formed between the two adjacent flow channels formed within each of the tubes. The formation of such bending moments may affect the durability of such tubes when exposed to extended periods of thermal cycling with varying temperatures experienced between the two flow channels of each of the tubes.

Additionally, the central partitioning wall adds rigidity to the interior of each of the tubes further restricting relative movement between the opposing surfaces of each of the tubes adjacent the central partitioning wall. The added rigidity adjacent the central partitioning wall exacerbates the incidence of failure due to thermal cycling because the different portions of each of the tubes experiencing different degrees of thermal expansion are restricted from moving and deforming relative to each other during use of the heat exchanger. The restricted motion may in some circumstances lead to increased bending moments or elevated stresses within portions of each of the tubes. These elevated stresses can lead to permanent deformation or eventual failure of one or more of the tubes following extended use thereof.

It would therefore be desirable to produce a tube for use in a heat exchanger having multiple flow channels in fluid communication with each other while also maximizing a compliancy of the tube for accommodating the thermal expansion thereof.

SUMMARY OF THE INVENTION

Compatible and attuned with the present invention, a tube having a modified central reinforcing structure for maximizing a compliancy of the tube, promoting fluid mixing within the tube, and creating turbulence within the fluid passed by the tube has surprisingly been discovered.

In one embodiment of the invention, a tube for use in a heat exchanger comprises a base portion, an upper portion spaced from and opposing the base portion, and a partitioning wall extending between the base portion and the upper portion to divide a hollow interior of the tube into a first flow channel and a second flow channel. The partitioning wall includes a plurality of windows spaced from each other in a longitudinal direction of the tube to provide fluid communication between the first flow channel and the second flow channel. At least one of the windows includes a tabbed portion of the partitioning wall bent to extend into one of the first flow channel or the second flow channel.

In another embodiment of the invention, a heat exchanger comprises a first header tank including a first tube opening formed therein and a tube having a first end portion received in the first header tank through the first tube opening. The tube includes a base portion, an upper portion spaced from and opposing the base portion, and a partitioning wall extending between the base portion and the upper portion to divide a hollow interior of the tube into a first flow channel and a second flow channel. The partitioning wall includes a plurality of windows spaced from each other in a longitudinal direction of the tube to provide fluid communication between the first flow channel and the second flow channel, wherein a first one of the windows is disposed in alignment with a surface of the first header tank defining the first tube opening with respect to the longitudinal direction of the tube.

In another embodiment of the invention, a method of forming a tube for a heat exchanger is disclosed. The method comprises the steps of: providing a sheet of material; removing a portion of the sheet of material to form a first opening from a first portion of the sheet, wherein a portion of a perimeter of the first opening defines a first tabbed portion of the sheet; bending the first tabbed portion of the sheet about a first pivot portion connecting the first tabbed portion to the first portion of the sheet; and bending the sheet into a tubular shape.

BRIEF DESCRIPTION OF THE DRAWINGS

The above, as well as other objects and advantages of the invention, will become readily apparent to those skilled in the art from reading the following detailed description of a preferred embodiment of the invention when considered in the light of the accompanying drawings.

DETAILED DESCRIPTION OF THE INVENTION

The following detailed description and appended drawings describe and illustrate various embodiments of the invention. The description and drawings serve to enable one skilled in the art to make and use the invention, and are not intended to limit the scope of the invention in any manner. In respect of the methods disclosed, the steps presented are exemplary in nature, and thus, the order of the steps is not necessary or critical.

Figure 1:
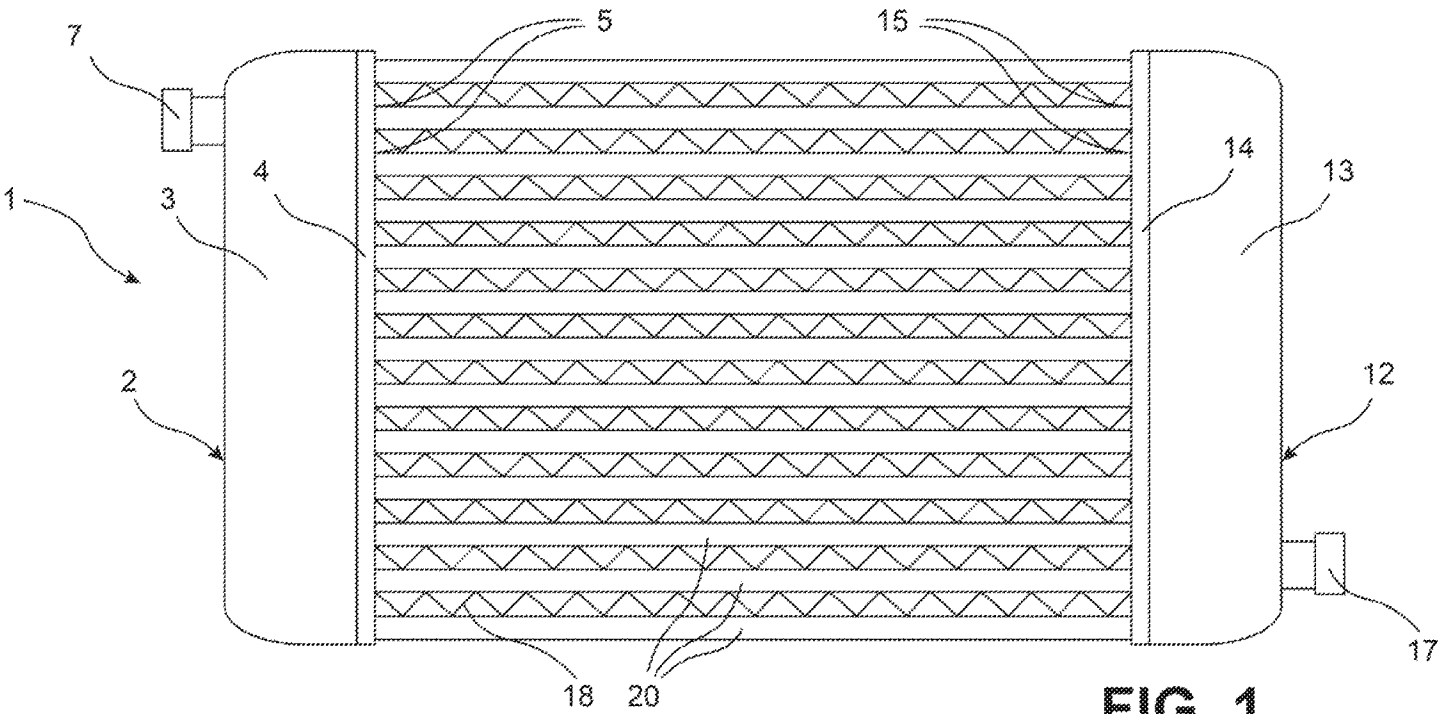
FIG. 1 is an elevational view of a heat exchanger for a motor vehicle according to an embodiment of the invention.

FIG. 1 illustrates a heat exchanger 1 according to an embodiment of the invention. The heat exchanger 1 may be used in an automotive application such as forming a portion of a heating, ventilating, and air conditioning (HVAC) system or a portion of a cooling system for regulating a temperature of one or more components of the automobile, as desired. The heat exchanger 1 may form an evaporator, a condenser, or a radiator of the motor vehicle, as non-limiting examples. The heat exchanger 1 may alternatively be used for any application requiring the exchange of heat energy between two or more fluids, as desired. The heat exchanger 1 generally comprises a first header tank 2, a second header tank 12, and a plurality of heat exchanger tubes 20 extending longitudinally between the first header tank 2 and the second header tank 12.

The first header tank 2 includes a first casing 3 and a first header 4. The first casing 3 defines a hollow opening for distributing or recombining the first fluid passed through the heat exchanger tubes 20. The first casing 3 includes a first fluid port 7 providing fluid communication between the first casing 3 and an associated fluid system (not shown) associated with the heat exchanger 1. The first fluid port 7 may form an inlet or an outlet with respect to the first header tank 2 based on a desired mode of operation of the associated fluid system. The first header 4 includes a plurality of first tube openings 5 spaced apart from each other with respect to a longitudinal direction of the first header 4. The first header tank 2 is configured to receive an end portion of each of the tubes 20 through one of the first tube openings 5 of the first header 4. The first header 4 may be coupled to the first casing 3 by any method including crimping, welding, or brazing, as non-limiting examples. Additionally, although the first header tank 2 is described as having an independently formed first header 4 coupled to the first casing 3, it should be understood by one skilled in the art that the first header tank 2 may have any suitable structure for receiving the end portions of the tubes 20 without necessarily departing from the scope of the present invention. As such, any structure of the first header tank 2 including a plurality of spaced apart tube openings suitable for receiving the tubes 20 may be considered to be the disclosed first header 4 without departing from the scope of the present invention.

The second header tank 12 includes a second casing 13 and a second header 14. The second casing 13 defines a hollow opening for distributing or recombining the first fluid passed through the tubes 20. The second casing 13 includes a second fluid port 17 providing fluid communication between the second casing 13 and the fluid system associated with the heat exchanger 1. The second fluid port 17 may form an inlet or an outlet with respect to the second header tank 12 based on a desired mode of operation of the associated fluid system. The second header 14 includes a plurality of second tube openings 15 spaced apart from each other with respect to a longitudinal direction of the second header 14. The second header tank 12 is configured to receive an end portion of each of the tubes 20 through one of the second tube openings 15 of the second header 14. The second header 14 may be coupled to the second casing 13 by any method including crimping, welding, or brazing, as non-limiting examples. Additionally, although the second header tank 12 is described as having an independently formed second header 14 coupled to the second casing 13, it should be understood by one skilled in the art that the second header tank 12 may have any suitable structure for receiving the end portions of the tubes 20 without necessarily departing from the scope of the present invention. As such, any structure of the second header tank 12 including a plurality of spaced apart tube openings suitable for receiving the tubes 20 may be considered to be the disclosed second header 14 without departing from the scope of the present invention.

A plurality of serpentine or convoluted fins 18 may be disposed in spaces formed between adjacent ones of the tubes 20. The spaces formed between the adjacent ones of the tubes 20 are configured to receive a second fluid such as air, for exchanging heat energy between the second fluid and the first fluid conveyed within the plurality of the tubes 20. The fins 18 are configured to increase a surface area of the heat exchanger 1 exposed to the flow of the second fluid to increase an efficiency of heat transfer between the first and second fluids.

Figure 2:
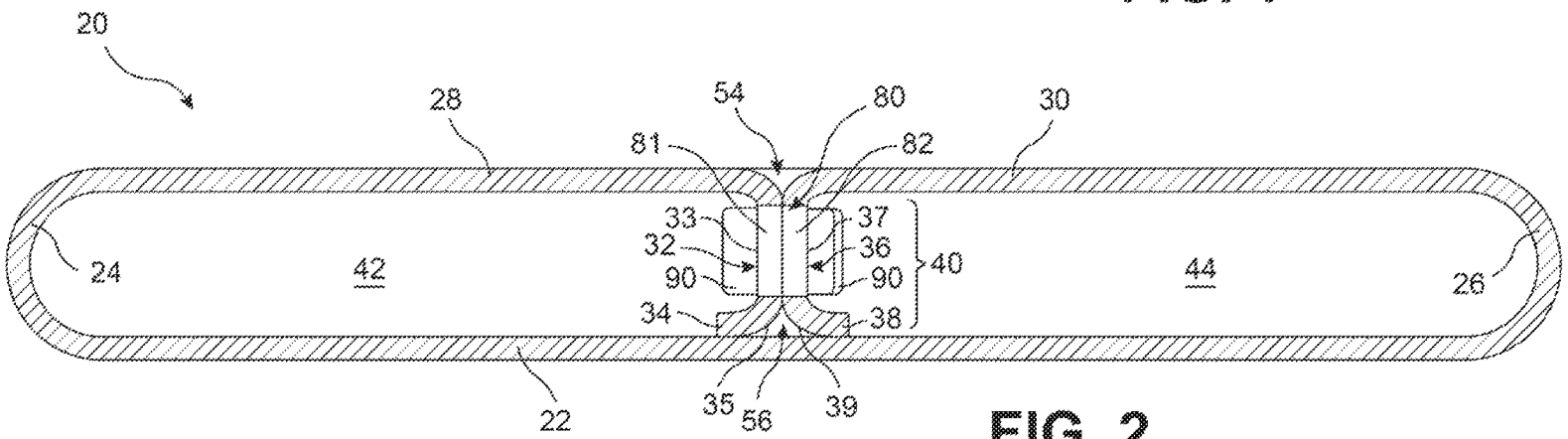
FIG. 2 is a cross-sectional view of a tube for use in the heat exchanger illustrated in FIG. 1, wherein the cross-section is taken through a portion of the tube having a window formed therein.

As best shown in FIG. 2, which illustrates a cross-section through one of the tubes 20, each of the tubes 20 includes a base portion 22, a first side portion 24 extending from a first end of the base portion 22, a second side portion 26 arranged opposite the first side portion 24 and extending from a second end of the base portion 22, a first upper portion 28 extending inwardly from the first side portion 24, a second upper portion 30 extending inwardly from the second side portion 26, a first partitioning portion 32 depending from the first upper portion 28 towards the base portion 22, and a second partitioning portion 36 depending from the second upper portion 30 towards the base portion 22. The base portion 22, the first upper portion 28, and the second upper portion 30 extend primarily laterally or in a width direction of the tube 20 between the first side portion 24 and the oppositely arranged second side portion 26. The first and second side portions 24, 26 may be substantially arcuate in shape having a desired radius of curvature, but other shapes may be used without departing from the scope of the present invention, such as a substantially rectangular or triangular cross-sectional shape.

The first partitioning portion 32 includes a first leg 33, a second leg 34, and a bend portion 35 connecting the first leg 33 to the second leg 34. The first leg 33 extends in a height direction of the tube 20 perpendicular to the width direction thereof. In some embodiments, the first leg 33 may be disposed at a slight angle relative to the height direction of the tube 20 without necessarily departing from the scope of the present invention. The second leg 34 may be arranged substantially perpendicular to the first leg 33 and in contact with the base portion 22. In some embodiments, the second leg 34 may be bent at an acute angle relative to the first leg 33 in a manner wherein a distal end of the second leg 34 is spaced from the base portion 22. Alternative shapes of the first partitioning portion 32 may be used without departing from the scope of the present invention.

The second partitioning portion 36 includes a first leg 37, a second leg 38, and a bend portion 39 connecting the first leg 37 to the second leg 38. The first leg 37 extends in a height direction of the tube 20 perpendicular to the width direction and the longitudinal direction thereof. In some embodiments, the first leg 37 may be disposed at a slight angle relative to the height direction of the tube 20 without necessarily departing from the scope of the present invention. The second leg 34 may be arranged substantially perpendicular to the first leg 37 and in contact with the base portion 22. In some embodiments, the second leg 38 may be bent at an acute angle relative to the first leg 37 in a manner wherein a distal end of the second leg 38 is spaced from the base portion 22. Alternative shapes of the first partitioning portion 36 may be used without departing from the scope of the present invention.

The first partitioning portion 32 and the second partitioning portion 36 cooperate to form a partitioning wall 40 dividing a hollow interior of the tube 20 into a first flow channel 42 formed to a first side of the partitioning wall 40 and a second flow channel 44 formed to a second side of the partitioning wall 40. The first flow channel 42 and the second flow channel 44 may be shaped and dimensioned to be substantially symmetric about a plane generally defined by the partitioning wall 40, as desired.

Figure 7:
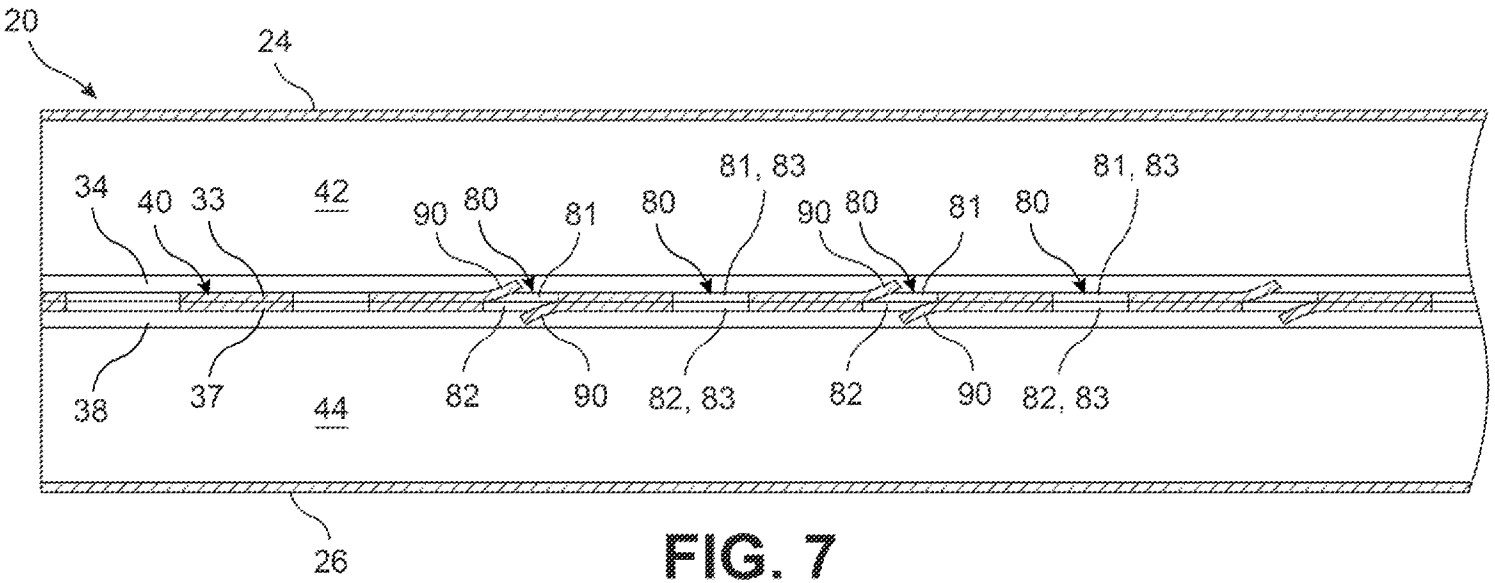
FIG. 7 is a fragmentary cross-sectional view of a tube having an arrangement of windows formed in a partitioning wall of the tube according to an embodiment of the invention.
Figure 13:
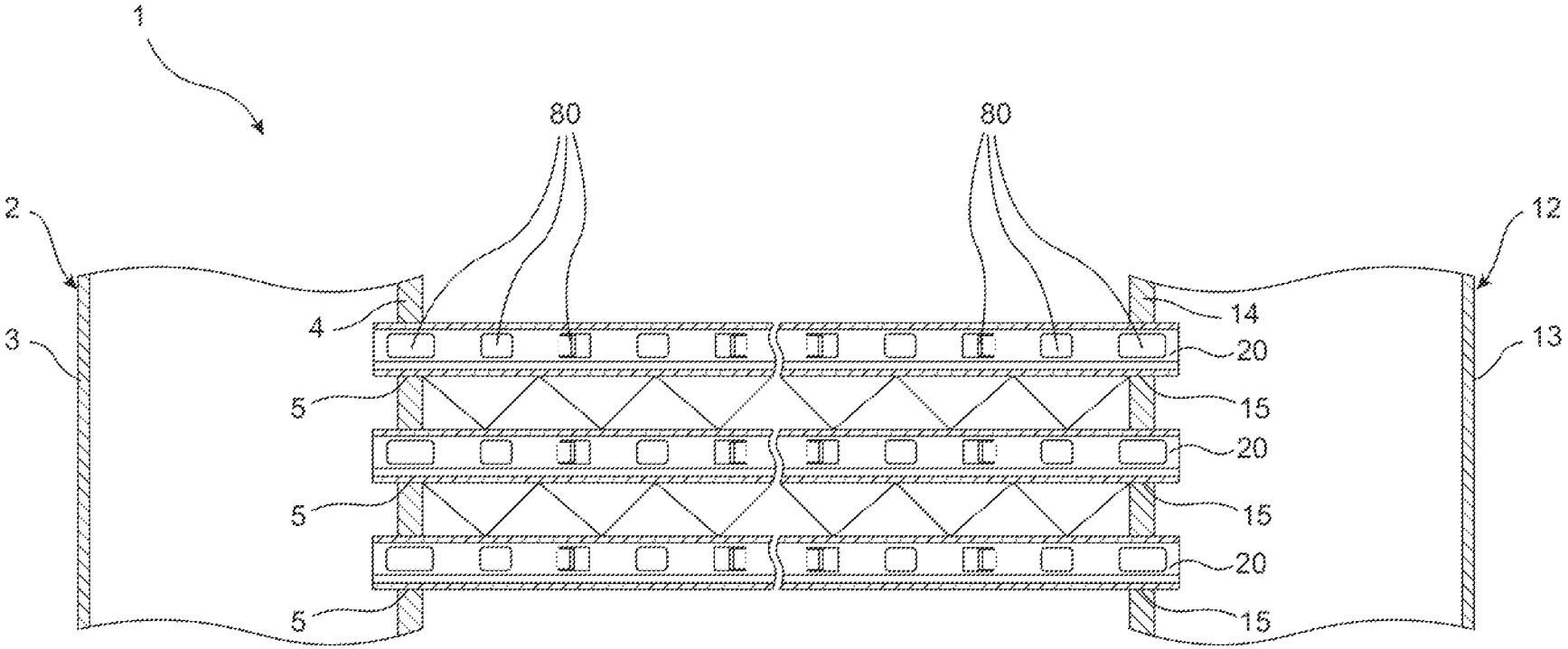
FIG. 13 is a fragmentary cross-sectional view of a heat exchanger having a plurality of the tubes received in each of a first header tank and a second header tank.

As best shown in FIGS. 7 and 13, the partitioning wall 40 includes a plurality of longitudinally spaced windows 80 formed therein. Each of the windows 80 extends through the partitioning wall 40 to provide fluid communication between the first flow channel 42 and the second flow channel 44. Each of the windows 80 is formed by the cooperation of a first window 81 formed through the first leg 33 of the first partitioning portion 32 and a second window 82 formed through the first leg 37 of the second partitioning portion 36. Each of the first windows 81 includes a portion of the first leg 33 of the first partitioning portion 32 removed or displaced from a plane generally defined by the first leg 33 of the first partitioning portion 32. Similarly, each of the second windows 82 includes a portion of the first leg 37 of the second partitioning portion 36 removed or displaced from a plane generally defined by the first leg 37 of the second partitioning portion 36.

Each of the first windows 81 may be at least partially aligned with a corresponding second window 82 with respect to the longitudinal direction of the tube 20 to establish a fluid flow path between each of the first windows 81 and a corresponding one of the second windows 82. In other words, at least one plane arranged perpendicular to the longitudinal direction of the tube 20 passes through each of the first windows 81 and a corresponding one of the second windows 82 cooperating to form each individual one of the windows 80. As shown in FIG. 7, the first and second windows 81, 82 may be substantially aligned in a manner wherein each pair of the first and second windows 81, 82 share both a leading edge and a trailing edge with respect to the longitudinal direction of the tube 20, wherein the leading edge refers to an edge defining one of the first or second windows 81, 82 first encountering a flow of fluid through the tube 20 while the trailing edge refers to an edge defining one of the first or second windows 81, 82 that is passed last by the flow of fluid when flowing past the corresponding one of the first or second windows 81, 82. The substantial alignment of both the leading edges and the trailing edges of each of the corresponding pairs of first and second windows 81, 82 aids in forming the tube 20 to be passable in either of two opposing flow directions without significantly affecting the operation of the tube 20 based on the selected flow direction. The alignment of the first and second windows 81, 82 further aids in presenting the desired degree of compliancy within each of the tubes 20, as explained in greater detail hereinafter.

The tube 20 is generally formed by bending a sheet of a metallic material such as aluminium into the tubular cross-sectional shape illustrated in FIG. 2 for delimiting a flow of the first fluid therethrough. For example, with reference to FIG. 3, a sheet 50 of material is marked with longitudinally extending lines A, B, C, D, E, F, G, and H indicating divisions of the sheet 50 corresponding to the features identified in FIG. 2. The second leg 34 of the first partitioning portion 32 is formed in the sheet 50 intermediate the line A and a first side edge 51 of the sheet 50, the first leg 33 of the first partitioning portion 32 is formed intermediate the lines A and B, the first upper portion 28 is formed intermediate the lines B and C, the first side portion 24 is formed intermediate the lines C and D, the base portion 22 is formed intermediate the lines D and E, the second side portion 26 is formed intermediate the lines E and F, the second upper portion 30 is formed intermediate the lines F and G, the first leg 37 of the second partitioning portion 36 is formed intermediate the lines G and H, and the second leg 38 of the second partitioning portion 36 is formed intermediate the line H and a second side edge 52 of the sheet 50.

The first windows 81 and the second windows 82 may be formed in the sheet 50 prior to the bending or folding of the sheet 50 into the tubular structure shown and described herein. As previously indicated, each of the first windows 81 is formed in the first leg 33 of the first partitioning portion 32, which corresponds to a portion of the sheet 50 disposed intermediate the lines A and B, while each of the second windows 82 is formed in the first leg 37 of the second partitioning portion 36, which corresponds to a portion of the sheet 50 disposed intermediate the lines G and H. The first windows 81 and the second windows 82 may each include a width as measured in the lateral direction of the sheet 50 that is substantially equal to or slightly less than a distance measured between the lines A and B or the lines G and H, hence each of the first and second windows 81, 82 may have a height that is substantially equal to or slightly less than a height of each of the first legs 33, 37 of the first and second partitioning portions 32, 36 when the tube 20 is formed into the shape disclosed in FIG. 2.

The first windows 81 and the second windows 82 are formed using an identical manufacturing process, hence description hereinafter is focused on the formation of each of the first windows 81. The first windows 81 may be formed to include one of two different general configurations, wherein the two different configurations may be used in combination to form a desired pattern of the first windows 81 (and similarly the second windows 82) for forming a desired flow configuration through the tube 20.

According to a first configuration, one or more of the first windows 81 may be presented as an opening forming a through-hole 83 through the sheet 50 wherein an entirety of the first window 81 is punched or cut away from the sheet 50. The punching or cutting of the through-hole 83 from the sheet 50 results in an entirety of a perimeter 84 of the through-hole 83 being formed by an inner surface 55 of the sheet 50 connecting one major surface thereof to an opposing major surface thereof. The inner surface 55 defining the through-hole 83 forms a closed shape surrounding a flow path connecting the two major surfaces of the sheet 50.

The closed shape of each of the first windows 81 formed as a through-hole 83 is shown throughout as a substantially rectangular or rounded-rectangular shape, but it should be understood that each of the first windows 81 formed as a through-hole 83 may be formed to have any closed shape including a triangular shape, a trapezoidal shape, an elliptical shape, a circular shape, or the like, as desired, while remaining within the scope of the present invention.

Figure 3:
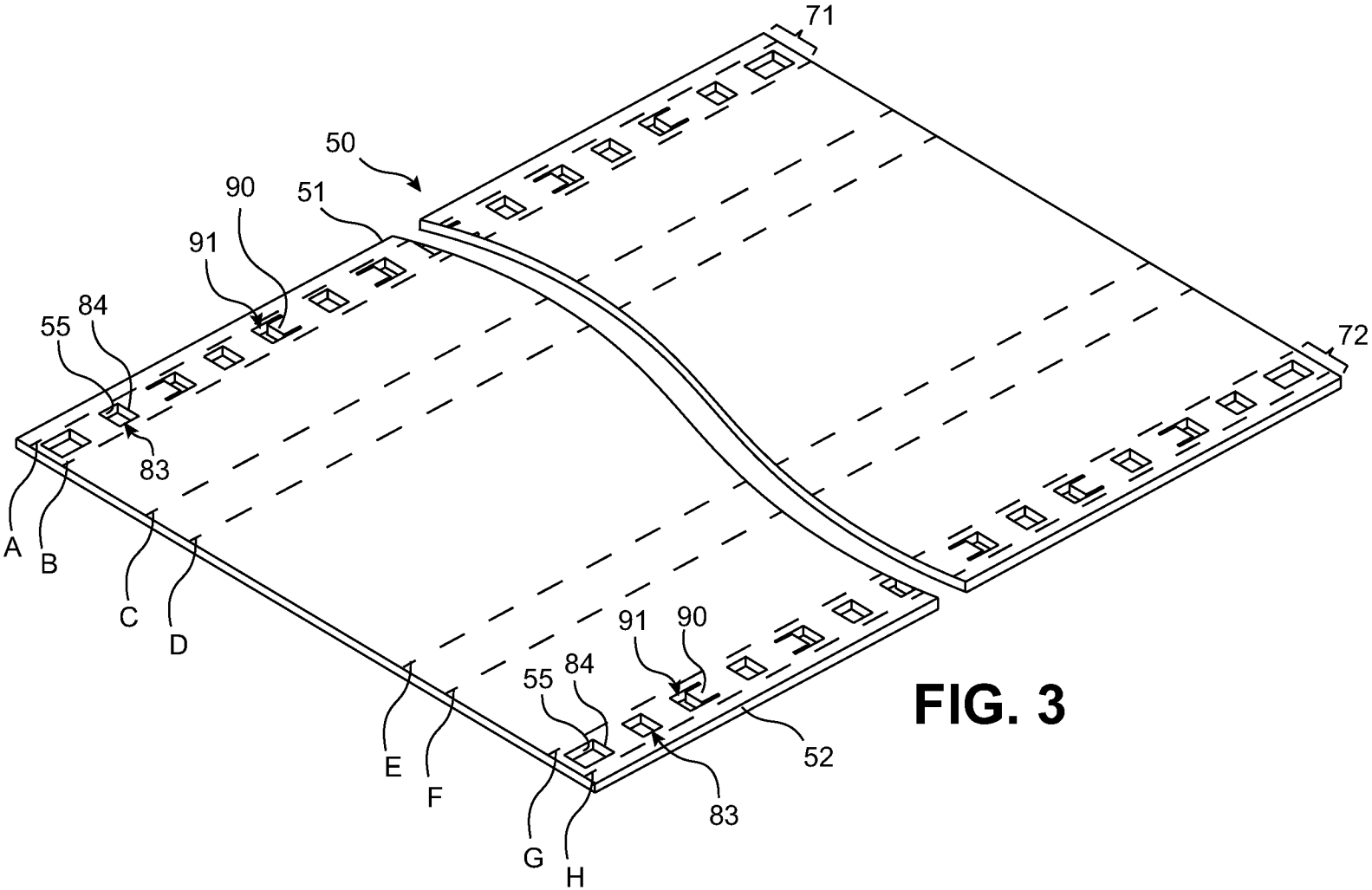
FIG. 3 is a fragmentary perspective view of a sheet of material for forming the tube illustrated in FIG. 2.

According to a second configuration, one or more of the first windows 81 may be formed to include a tabbed portion 90 bent to be arranged at an angle with respect to the plane of the sheet 50 between the lines A and B of FIG. 3, and hence the plane of the resulting first leg 33 of the first partitioning portion 32 following completion of the formation of the sheet 50 into the tubular structure shown in FIG. 2.

Figure 4:
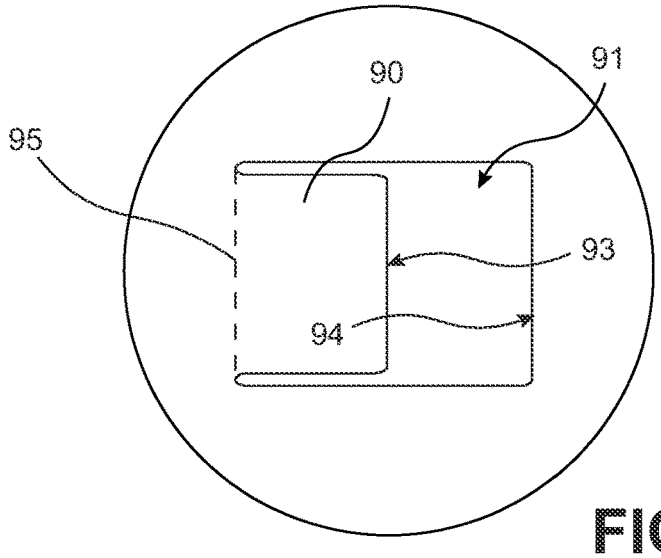
FIG. 4 is an enlarged fragmentary top plan view of an opening formed in the sheet of FIG. 3 for forming a window within the tube according to an embodiment of the invention.
Figure 5:
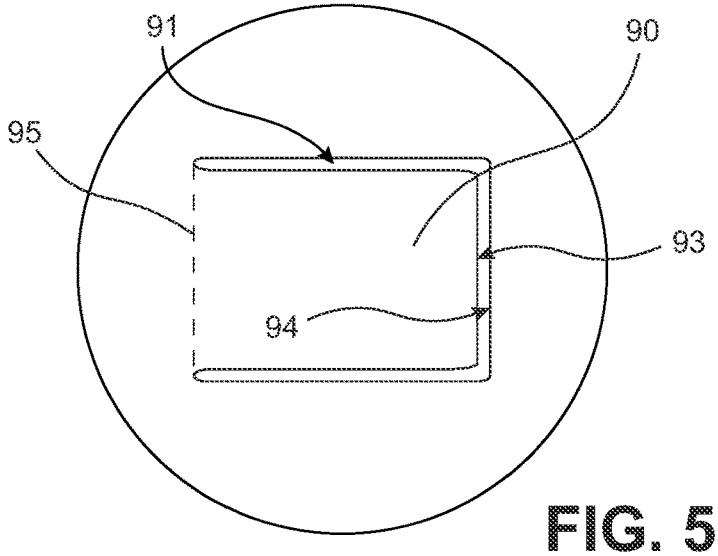
FIG. 5 is an enlarged fragmentary top plan view of an opening formed in the sheet of FIG. 3 for forming a window within the tube according to another embodiment of the invention.
Figure 6:
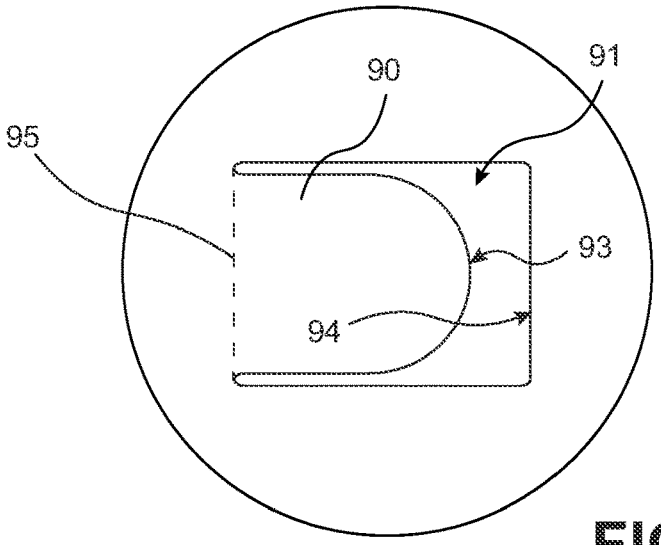
FIG. 6 is an enlarged fragmentary top plan view of an opening formed in the sheet of FIG. 3 for forming a window within the tube according to yet another embodiment of the invention.

The tabbed portion 90 is manufactured by first forming an opening 91 through the sheet 50 from one major surface to an opposing major surface thereof in similar fashion to the through-hole 83 of the above described first configuration. As shown in FIGS. 4-6, the opening 91 may be formed to have any number of different configurations suitable for forming a desired shape of the tabbed portion 90 and the remainder of the first window 81 following the bending or folding of the tabbed portion 90 away from the plane of the sheet 50 without departing from the scope of the present invention.

The opening 91 is punched or cut from the sheet 50 to include a perimeter divided into a first portion 93 and a second portion 94. The first portion 93 of the perimeter defines an outer surface of the tabbed portion 90 while the second portion 94 of the perimeter defines a portion of a perimeter of the resulting first window 81 following the bending or folding of the tabbed portion 90. The tabbed portion 90 is bent or folded about a pivot portion 95 thereof (see FIGS. 4-6) disposed on the plane of the sheet 50 intermediate the lines A and B and forms a line about which the tabbed portion 90 is bent or folded away from the plane of the sheet 50 (and hence the plane of the resulting first leg 33 of the first partitioning portion 32) to further increase a cross-sectional flow area through the first window 81. The resulting first window 81 having the second configuration accordingly includes a perimeter shape formed by the cooperation of the pivot portion 95 of the tabbed portion 90 and the second portion 94 of the perimeter of the opening 91. The pivot portion 95 of each of the tabbed portions 90 may be arranged to extend in the height direction of the resulting tube 20 (perpendicular to the longitudinal direction thereof) to allow the corresponding tabbed portion 90 to pivot about an axis extending in the height direction of the resulting tube 20.

As shown in FIG. 4, the opening 91 may be formed in a manner wherein the tabbed portion 90 occupies a smaller area than the resulting first window 81 due to the tabbed portion 90 being formed to include at least one dimension smaller than a corresponding dimension of the resulting first window 81. For example, the tabbed portion 90 may include a substantially rectangular shape with a lateral dimension substantially similar to the lateral dimension of the resulting first window 81 (but slightly smaller due to the thickness of the cut or punch separating the tabbed portion 90 from the sheet 50) and a longitudinal dimension that is smaller than a longitudinal dimension of the resulting first window 81. The tabbed portion 90 is shown in FIG. 4 as extending a distance about half a distance of the resulting first window 81 with respect to the longitudinal direction of the sheet 50. As such, each of the opposing major surfaces of the tabbed portion 90 may have a surface area about half a cross-sectional flow area through the first window 81 following the bending or folding of the tabbed portion 90. This arrangement of the openings 91 is also shown in each of FIGS. 2, 3, 7, and 13.

As shown in FIG. 5, one or more of the tabbed portions 90 may include the same general perimeter shape and size as each of the resulting first windows 81 formed by the bending or folding of the corresponding tabbed portion 90 away from the plane of the sheet 50. This arrangement may be produced when the opening 91 is formed to include the first portion 93 and the second portion 94 of the perimeter as substantially coinciding with each other, such as where the opening 91 is formed as one or more slits forming the perimeter of the tabbed portion 90 with the exception of the pivot portion 95 thereof. Such a configuration is also shown with reference to the tube 20 shown in FIG. 9, which is described in greater detail hereinafter.

As shown in FIG. 6, the opening 91 may be formed wherein the tabbed portion 90 has both a different shape and size in comparison to the resulting first window 81 formed by the bending or folding of the tabbed portion 90. For example, the first portion 93 of the perimeter may be formed to include a substantially semi-circular portion whereas the second portion 94 of the perimeter may be formed to cooperate with the pivot portion 95 to form a first window 81 with a substantially rectangular cross-sectional shape different from the shape of the tabbed portion 90. One skilled in the art should appreciate that any combination of shapes may be used for each portion 93, 94 of the perimeter of the opening 91 without departing from the scope of the present invention.

A single punching or cutting operation may be performed to form both the through-holes 83 of the first configuration and the openings 91 of the second configuration. Following the punching or cutting of the sheet 50, a suitable tool may be used to apply a force to the sheet 50 at each of the tabbed portions 90 formed by the creation of the openings 91 while the remainder of the sheet 50 is constrained in position. The tool may cause each of the tabbed portions 90 to pivot away from the plane of the sheet 50 surrounding each of the tabbed portions 90 about the corresponding pivot portion 95 thereof to orient each of the tabbed portions 90 at an angle with respect to the plane of the sheet 50 surrounding each of the tabbed portions 90. The tabbed portions 90 may be pivoted to any angle with respect to the plane of the sheet 50, but may be preferably pivoted to be arranged at an acute angle relative to the plane of the sheet 50 between about 5 and 45 degrees. As should be understood, an angle of displacement of the tabbed portion 90 relative to the plane of the surrounding portion of the sheet 50 corresponds to an angle of displacement of the tabbed portion 90 relative to the first leg 33 of the first partitioning portion 32 following formation of the tube 20.

The tabbed portions 90 of the first windows 81 are angularly displaced from the plane of the first leg 33 to extend at least partially into the first flow channel 42 formed to one side of the partitioning wall 40. Following the bending or folding of each of the tabbed portions 90, each of the tabbed portions 90 may include a leading surface and a trailing surface. The leading surface refers to a surface of each of the tabbed portions 90 that faces towards and redirects a flow of the first fluid through each of the tubes 20 while the trailing surface refers to a surface of each of the tabbed portions 90 that faces away from the flow of the first fluid through each of the tubes 20. The leading surface and the trailing surface of each of the tabbed portions 90 may be alternated depending on a direction of flow of the first fluid through each of the tubes 20, such as when the heat exchanger 1 is configured to be passed by the first fluid bi-directionally.

As best shown in FIG. 3, the second windows 82 are similarly formed by removing a portion of the sheet of material to form a combination of through-holes 83 and openings 91 from the sheet 50. The second windows 82 may have any of the shapes and configurations described herein with reference to the first windows 81. The through-holes 83 and the openings 91 forming the second windows 82 may be formed in the same punching or cutting operation used to form the first windows 81 as described hereinabove. The tabbed portions 90 of the second windows 82 may be bent or folded away from a plane of the portion of the sheet 50 using the same tool as described with reference to the first windows 81, and the bending or folding may occur simultaneously with respect to each of the first windows 81 and the second windows 82.

The bending or folding of each of the tabbed portions 90 of the second windows 82 results in each of the tabbed portions 90 being arranged at an angle with respect to the plane of the first leg 37 of the second partitioning portion 36 following the formation of the sheet 50 into the tube 20 of FIG. 2. The tabbed portions 90 of the second windows 82 are arranged to extend at least partially into the second flow channel 44 formed opposite the first flow channel 42. Each of the tabbed portions 90 of the second windows 82 accordingly includes a leading surface and a trailing surface depending on the direction of flow of the first fluid through the corresponding tube 20 in similar fashion to the tabbed portions 90 of the first windows 81 described herein.

The bending of the tube 20 into the cross-sectional shape shown in FIG. 2 may occur according to the following steps. The sheet 50 may be folded about the line A to cause the second leg 34 of the first partitioning portion 32 to be disposed at an angle relative to the first leg 33 thereof while also folding the sheet 50 about the line H to cause the second leg 38 of the second partitioning portion 36 to be disposed at an angle relative to the first leg 37 thereof. Next, the sheet 50 is folded about the lines B and G to complete formation of each of the first partitioning portion 32 and the second partitioning portion 36, respectively. The folding of the sheet 50 about the line B causes the first partitioning portion 32 to be angled relative to the portion of the sheet 50 defining the first upper portion 28 while the folding of the sheet 50 about the line G causes the second partitioning portion 36 to be angled relative to the portion of the sheet 50 defining the second upper portion 30.

The sheet 50 is then bent into a substantially arcuate shape between each of the lines C and D and the lines E and F to cause formation of the first side portion 24 and the second side portion 26, respectively. The formation of the side portions 24, 26 causes the first partitioning portion 32 to be brought towards the second partitioning portion 36 while also causing the first and second upper portions 28, 30 to be arranged substantially parallel to the base portion 22. One skilled in the art should appreciate that the sheet 50 may be bent in an alternative order while still arriving at the same cross-sectional shape illustrated in FIG. 2, including folding the first legs 33, 37 relative to the second legs 34, 38 following the bending of the remainder of the tube 20, as one non-limiting example.

Following the initial bending of the tube 20 described hereinabove, the first leg 33 of the first partitioning portion 32 abuts the first leg 37 of the second partitioning portion 36 to form a seam 54 extending along a length of the tube 20. Additionally, the second leg 34 of the first partitioning portion 32 is in contact with the base portion 22 of the tube 20 at a position spaced apart in the width direction of the tube 20 from a position the second leg 38 of the second partitioning portion 36 contacts the base portion 22 of the tube 20 to form a fillet 56 therebetween. The seam 54 and the fillet 56 may be suitable regions for receiving a brazing material during a brazing operation suitable for coupling the first and second partitioning portions 32, 36 to the base portion 22.

The tube 20 is generally described as including the base portion 22 arranged parallel to the first and second upper portions 28, 30 intermediate the first and second side portions 24, 26, but it should be understood that those portions of the tube 20 formed to either lateral side of the partitioning wall 40 may have alternative shapes without affecting operation of the tube 20. The tube 20 may for example have flared lateral regions as is disclosed in pending U.S. Patent Application Publication No. 2014/0196877 to Wilkins et al., which is hereby incorporated herein by reference in its entirety.

The initial process of bending the tube 20 may therefore be summarized as including the bending of a first end region 71 of the sheet 50, which extends between the first side edge 51 and the line B and corresponds to the first partitioning portion 32 of the tube 20, towards a second end region 72 of the sheet 50, which extends between the second side edge 52 and the line G and corresponds to the second partitioning portion 36 of the tube 20, to form a closed tubular structure for delimiting a flow of the first fluid therethrough. The first end region 71 is additionally brought into abutment with the second end region 72 in a manner wherein each of the end regions 71, 72 spans the height dimension of the tube 20 extending between the base portion 22 and the first and second upper portions 28, 30, thereby forming the partitioning wall 40 for delimiting the flow of the first fluid into each of the first flow channel 42 formed to the first side of the partitioning wall 40 and the second flow channel 44 formed to the second side of the partitioning wall 40.

The tabbed portions 90 of the first windows 81 and the second windows 82 are described as being bent or folded prior to the formation of the sheet 50 into the tubular shape of FIG. 2, but it should be understood that each of the tabbed portions 90 may be bent or folded away from the plane of the surrounding portion of the sheet 50 (between lines A and B for the first windows 81 or between lines G and H for the second windows 82) at any point in the manufacturing process of the tube 20, including following the introduction of one or more of the folds necessary for forming the tubular shape of FIG. 2 as described herein.

At least one surface of each of the sheets 50 used to form the tubes 20 is coated with a brazing material which is commercially available and well known to those skilled in the art. The brazing material may for example be placed on a surface of the sheet 50 corresponding to an outermost surface of the tube 20 following the bending thereof into the tubular shape. Once the tube 20 has been received into the first and second tube openings 5, 15 of the first and second headers 4, 14, the entirety of the resulting assembly may be heated at a predetermined temperature to melt the brazing material disposed on the sheet 50 forming the tube 20, the brazing flux causing the brazing material to flow by capillary flow from the position of the seam 54 and into the braze receiving fillet area 56. The assembly is then cooled to solidify the molten braze material in the fillet area 56 to secure the partitioning wall 40 to the base portion 22. The heating and cooling of the braze material concurrently couples each of the tubes 20 to the first and second headers 4, 14 due to the inclusion of the brazing material between the outermost surface of the tube 20 and each of the tube openings 5, 15 formed in the respective headers 4, 14.

As shown in FIGS. 7-12, the resulting tube 20 may include any combination of the windows 80 formed as the through-holes 83 or the tabbed portions 90 as shown and described herein for creating a desired flow configuration through the tube 20.

Figure 8:
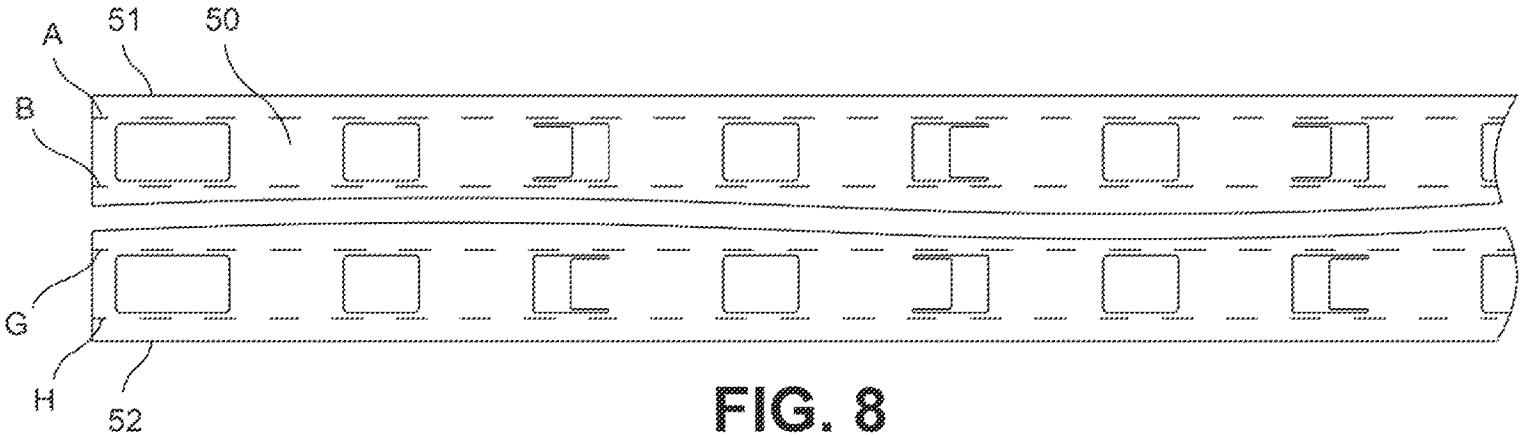
FIG. 8 is an enlarged fragmentary plan view of a pattern of openings formed in a sheet suitable for forming the tube of FIG. 7.

FIG. 7 illustrates one configuration of the completed tube 20 while FIG. 8 illustrates a pattern of the through-holes 83 and openings 91 formed in the sheet 50 suitable for forming the tube 20 of FIG. 7. The tube 20 includes at least one of the windows 80 formed by the cooperation of two of the through-holes 83 of the first configuration and at least one of the windows 80 formed by the cooperation of two of the openings 91 having the tabbed portions 90 of the second configuration. Specifically, the tabbed portions 90 of FIG. 7 are formed using the configuration of the openings 91 as disclosed in FIGS. 3 and 4 for forming the cooperating first and second windows 81, 82.

The openings 91 of the first windows 81 are arranged in reverse relative to the openings 91 of the second windows 82 to result in the corresponding tabbed portions 90 having opposing orientations with respect to the longitudinal direction of the tube 20. The opposing orientations of the tabbed portions 90 cause the leading surface of one of the tabbed portions 90 to divert a flow of the first fluid away from the partitioning wall 40 while the leading surface of the other of the tabbed portions 90 diverts the flow of the first fluid towards the partitioning wall 40 and through the corresponding window 80. The tabbed portions 90 as shown in FIG. 7 accordingly aid in increasing a turbulence of the first fluid while also aiding in communicating the first fluid between the first flow channel 42 and the second flow channel 44. A manner in which each of the tabbed portions 90 extending into the first flow channel 42 is arranged to extend in a direction opposite each of the tabbed portions 90 extending into the second flow channel 44 also beneficially allows for the tube 20 to be passed bi-directionally, wherein the first fluid encounters substantially the same flow pattern of the windows 80 regardless of the flow direction of the first fluid through the tube 20.

Figure 9:
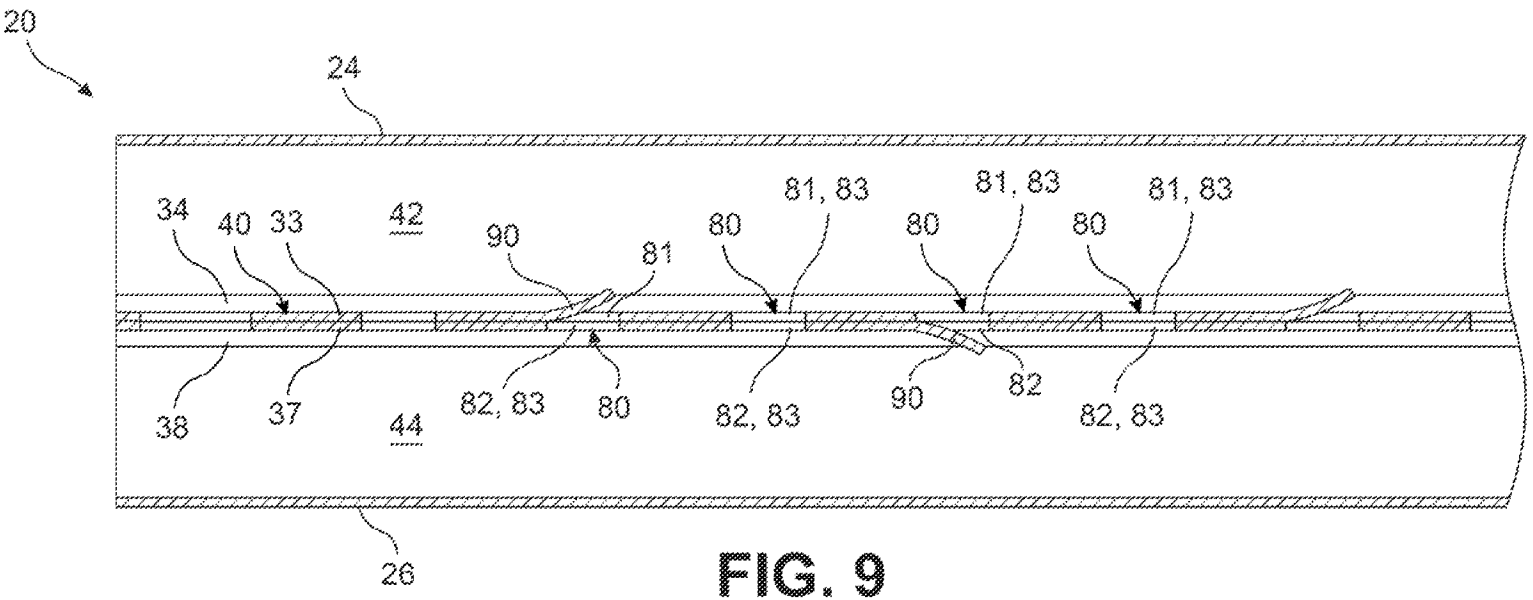
FIG. 9 is a fragmentary cross-sectional view of a tube having an arrangement of windows formed in a partitioning wall of the tube according to another embodiment of the invention.
Figure 10:
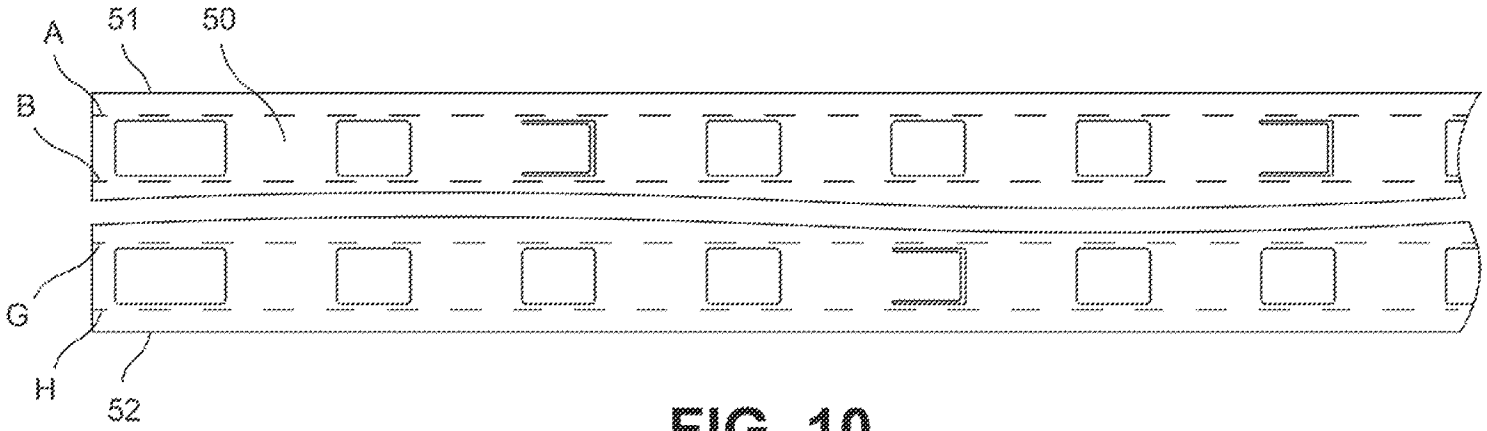
FIG. 10 is an enlarged fragmentary plan view of a pattern of openings formed in a sheet suitable for forming the tube of FIG. 9.

FIG. 9 illustrates another configuration of the completed tube 20 while FIG. 10 illustrates another pattern of the through-holes 83 and openings 91 formed in the sheet 50 suitable for forming the tube 20 of FIG. 9. The tube 20 includes at least one of the windows 80 formed by the cooperation of two of the through-holes 83 of the first configuration and at least one of the windows 80 formed by the cooperation of one of the through-holes 83 of the first configuration and one of the tabbed portions 90 of the second configuration. Specifically, the tabbed portions 90 of FIG. 9 are formed using the configuration of the openings 91 as disclosed in FIG. 5 wherein the tabbed portions 90 are similar in size and shape to the cross-sectional flow area through the corresponding window 80.

The tabbed portions 90 are shown in FIG. 9 as all extending longitudinally in a common direction while alternatingly extending to either side of the partitioning wall 40. As such, the tabbed portions 90 may present different flow configurations for the first fluid depending on a direction of flow thereof through the tube 20. Assuming the first fluid flows from left-to-right as shown in FIG. 9, the tabbed portions 90 primarily divert the first fluid outwardly while also presenting a flow path through each of the corresponding windows 80. Alternatively, assuming the first fluid flows from right-to-left as shown in FIG. 9, the tabbed portions 90 may primarily divert the first fluid inwardly in a direction through each of the corresponding windows 80.

Figure 11:
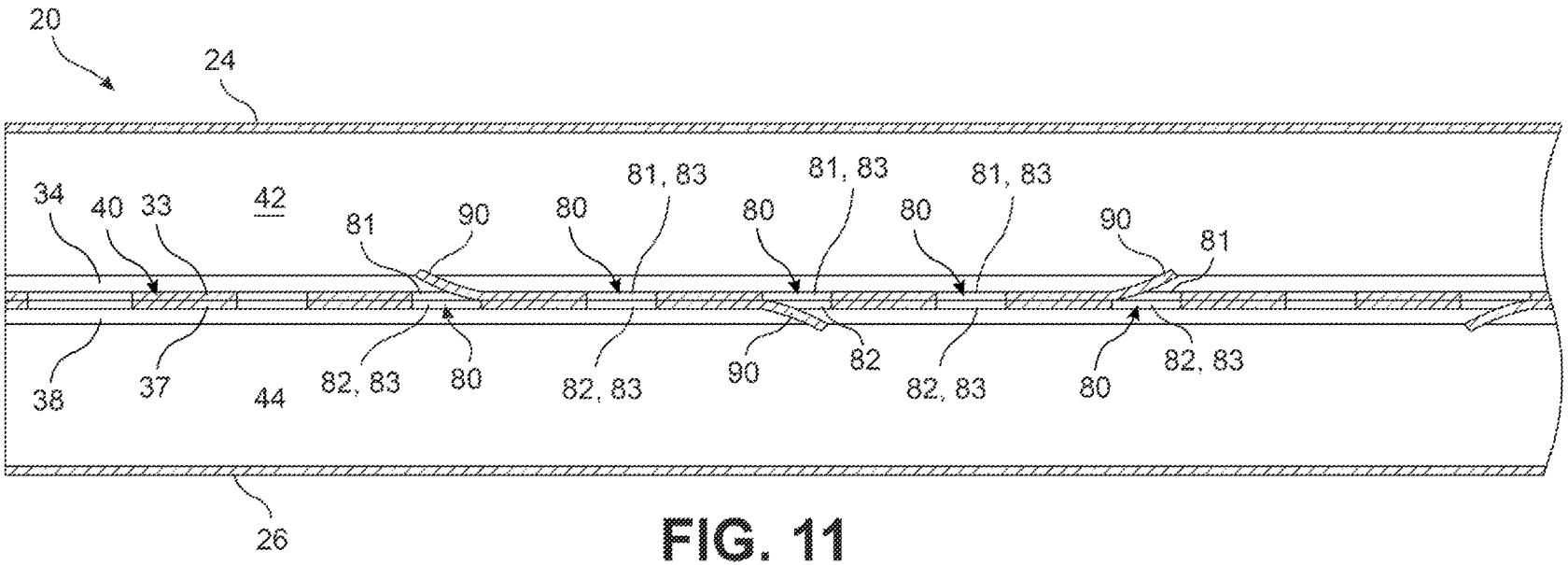
FIG. 11 is a fragmentary cross-sectional view of a tube having an arrangement of windows formed in a partitioning wall of the tube according to yet another embodiment of the invention.
Figure 12:
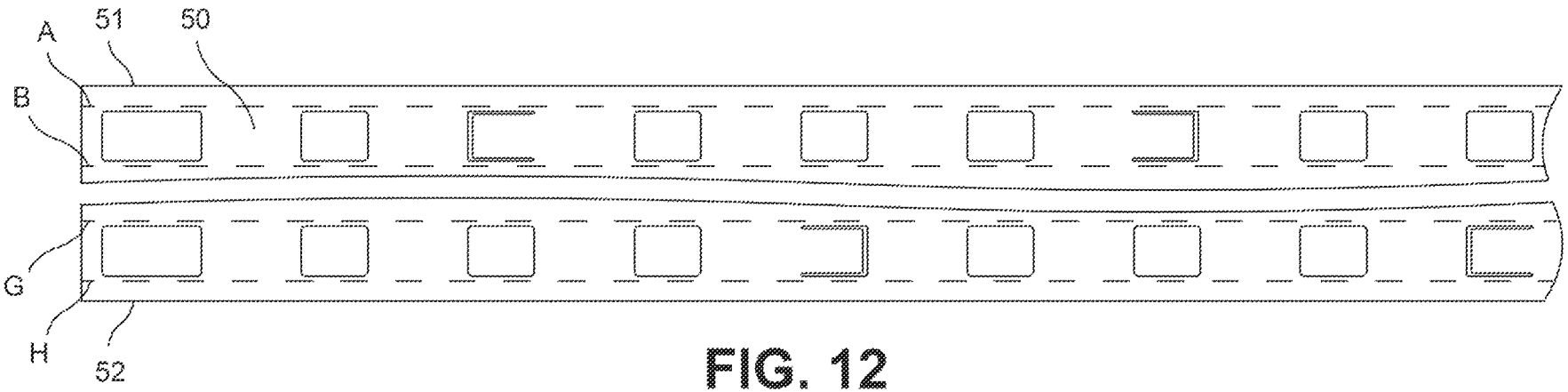
FIG. 12 is an enlarged fragmentary plan view of a pattern of openings formed in a sheet suitable for forming the tube of FIG. 11.

FIG. 11 illustrates yet another configuration of the completed tube 20 while FIG. 12 illustrates another pattern of the through-holes 83 and openings 91 formed in the sheet 50 suitable for forming the tube 20 of FIG. 11. The configuration of FIG. 11 includes the tabbed portions 90 having the same basic configuration as FIG. 9, but adjacent ones of the tabbed portions 90 on a common side of the partitioning wall 40 are oriented in opposing directions while an occurrence of the tabbed portions 90 alternates between the two sides of the partitioning wall 40. The flow configuration of FIG. 11 beneficially allows for the tube 20 to be passed bi-directionally without significantly affecting operation of the tube 20 due to the alternating configuration of the tabbed portions 90. As explained above with reference to FIGS. 7 and 9, some of the tabbed portions 90 tend to divert the first fluid towards the corresponding window 80 while some of the tabbed portions 90 tend to divert the first fluid outwardly away from the partitioning wall 40.

Each of the tubes 20 shown in FIGS. 7, 9, and 11 includes an alternating pattern of the windows 80 formed exclusively as through-holes 83 and the windows 80 wherein at least one of the first window 81 or the second window 82 is formed as one of the tabbed portions 90. However, any combination of the windows 80 formed as through-holes 83 and the windows 80 having tabbed portions 90 may be used without departing from the scope of the present invention. A number and frequency of the windows 80 having the tabbed portions 90 may be selected to impart a desired degree of turbulence in the first fluid and a desired degree of mixing between the first flow channel 42 and the second flow channel 44 in accordance with the heat exchange requirements of the heat exchanger 1.

The inclusion of the windows 80 in the partitioning wall 40 offers numerous benefits for altering the heat exchange characteristics of the tube 20. First, as mentioned above, the windows 80 of either disclosed general configuration allow for the first fluid to pass between the first flow channel 42 and the second flow channel 44. The mixing of the first fluid between the flow channels 42, 44 prevents an incidence of unequal thermal expansion present between the two flow channels 42, 44, which in turn prevents the formation of a bending moment between the different regions of the tube 20. Second, the inclusion of the windows 80 having the tabbed portions 90 further aids in adding turbulence to the first fluid when the first fluid encounters the leading surface of each of the tabbed portions 90, wherein such turbulence introduced into the first fluid increases a heat exchange efficiency of the tube 20. Third, the tabbed portions 90 may also be oriented in a manner further contributing to the tendency for the first fluid to flow between the first and second flow channels 42, 44 for further preventing the incidence of unequal thermal expansion between different regions of the tube 20.

The inclusion of the windows 80 in the partitioning wall 40 also causes the tube 20 to be more compliant adjacent the partitioning wall 40 than in a tube devoid of the windows. Each of the windows 80 corresponds to a portion of tube 20 having a cross-section devoid of the partitioning wall 40 when the cross-section is taken through a plane arranged perpendicular to the longitudinal direction of the tube 20, as can be seen in FIG. 2. As such, the windows 80 coincide with portions of the tube 20 wherein a rigid connection is not formed between the base portion 22 and the first and second upper portions 28, 30 thereof. The added compliancy introduced by the inclusion of the windows 80 allows for the tubes 20 to partially flex, expand, or contract adjacent the position of each of the windows 80 to accommodate any stresses experiences within the tube 20 as the result of unequal thermal expansion therein, thereby preventing failure of the tube 20 adjacent the partitioning wall 40 due to excessive rigidity thereof.

Referring now to FIG. 13, the first header 4 is shown as receiving first end portions of a plurality of the tubes 20 into the first tube openings 5 thereof while the second header 14 is shown as receiving opposing second end portions of the plurality of the tubes 20 into the second tube openings 15 thereof. As explained above, the end portions of the tubes 20 may be securely coupled to the headers 4, 14 following a suitable brazing process wherein an outer surface of each of the tubes 20 is surrounded by a surface of each of the headers 4, 14 forming one of the corresponding tube openings 5, 15. As such, those portions of each of the tubes 20 in direct contact with one of the surfaces defining one of the tube openings 5, 15 are further constricted from flexing, contracting, or expanding relative to the corresponding header 4, 14, thereby presenting another potential point of failure in each of the tubes 20 due to thermal cycling of the heat exchanger 1.

Each of the tubes 20 may accordingly include one of the windows 80 removed from the partitioning wall 40 at a position longitudinally aligned with each of the first header 4 and the second header 14. The inclusion of a window 80 at each prescribed location offers similar benefits to those described above wherein the tube 20 has additional compliancy for accommodating any expansions or contractions thereof relative to the first and second headers 4, 14. Although each of the windows 80 aligned with one of the headers 4, 14 is illustrated as being of the first configuration with a cooperating pair of through-holes 83 as the first and second windows 81, 82, it should be understood that any form or configuration of the windows 80 will similarly result in the removal of the rigid partitioning wall 40 at each location in need of additional compliancy.

As shown in FIG. 13, each of the windows 80 disposed in alignment with one of the respective headers 4, 14 may be formed to include a greater length in the longitudinal direction of the tube 20 in comparison to an adjacent one of the windows 80. The increased length of each of the windows 80 aids in adding compliancy to those portions of the tube 20 most susceptible to failure as a result of the secure coupling of the tube 20 to each of the respective headers 4, 14. Additionally, the added length of each of the windows 80 adjacent the interface between each of the respective headers 4, 14 and each of the tubes 20 ensures that each of the tubes 20 has sufficient fluid mixing immediately adjacent an inlet into each of the tubes 20. This added fluid mixing prevents an incidence of unequal thermal expansion that may occur between the two flow channels 42, 44 of each of the tubes 20 adjacent the inlet into each of the tubes 20, thereby further aiding in preventing failure at the rigid connection formed between each respective header 4, 14 and each of the tubes 20. The inclusion of a window 80 at this position accordingly aids in preventing elevated stresses within each of the tubes 20 while also further allowing for the tubes 20 and the headers 4, 14 to compliantly accommodate any deformations that may be caused by such elevated stresses.

From the foregoing description, one ordinarily skilled in the art can easily ascertain the essential characteristics of this invention and, without departing from the spirit and scope thereof, can make various changes and modifications to the invention to adapt it to various usages and conditions.

What is claimed is:

1. A tube for a heat exchanger, the tube comprising:

a base portion;

an upper portion spaced from and opposing the base portion; and a partitioning wall extending between the base portion and the upper portion to divide a hollow interior of the tube into a first flow channel and a second flow channel, the partitioning wall including a plurality of windows spaced from each other in a longitudinal direction of the tube to provide fluid communication between the first flow channel and the second flow channel, wherein at least one of the windows includes a tabbed portion of the partitioning wall bent to extend into the first flow channel or the second flow channel, wherein a first one of the windows which is disposed proximate to an end of the tube extends further in the longitudinal direction of the tube than an adjacent one of the plurality of the windows.

2. The tube according to claim 1, wherein the tube is formed from a sheet of material folded into a B-shape.

3. The tube according to claim 2, wherein the base portion corresponds to a central portion of the sheet, the upper portion corresponds to a first lateral portion and a second lateral portion of the sheet on opposing sides of the central portion of the sheet, and the partitioning wall corresponds to a first side portion and a second side portion of the sheet surrounding the first lateral portion and the second lateral portion of the sheet.

4. The tube according to claim 3, wherein each of the windows is formed by cooperation of a first window formed in the first side portion of the sheet and a second window formed in the second side portion of the sheet.

5. The tube according to claim 1, wherein the tabbed portion of the partitioning wall is arranged at an acute angle with respect to an adjacent portion of the partitioning wall.

6. The tube according to claim 1, wherein the tabbed portion extends at least partially in a direction towards a flow of a fluid through the tube as the tabbed portion projects away from an adjacent portion of the partitioning wall.

7. The tube according to claim 6, wherein a leading surface of the tabbed portion first encountering a flow of a fluid through the tube is configured to redirect a portion of the flow of the fluid through one of the first flow channel or the second flow channel into an other of the first flow channel or the second flow channel when flowing through one of the windows.

8. The tube according to claim 1, further comprising a plurality of tabbed portions of the partitioning wall bent to extend into one of the first flow channel or the second flow channel.

9. The tube according to claim 8, wherein the tabbed portions of the partitioning wall alternatingly extend into the first flow channel and the second flow channel with respect to the longitudinal direction of the tube.

10. The tube according to claim 1, wherein the tabbed portion of the partitioning wall is bent about a pivot portion of the tabbed portion connecting the tabbed portion to an adjacent portion of the partitioning wall.

11. The tube according to claim 10, wherein the pivot portion of the tabbed portion extends in a height direction of the tube between the base portion and the upper portion thereof.

12. A heat exchanger comprising:

a first header tank including a first tube opening formed therein; and a tube having a first end portion received in the first header tank through the first tube opening, the tube including a base portion, an upper portion spaced from and opposing the base portion, and a partitioning wall extending between the base portion and the upper portion to divide a hollow interior of the tube into a first flow channel and a second flow channel, the partitioning wall including a plurality of windows spaced from each other in a longitudinal direction of the tube to provide fluid communication between the first flow channel and the second flow channel, wherein a first one of the windows is disposed in alignment with a surface of the first header tank defining the first tube opening with respect to the longitudinal direction of the tube, wherein the first one of the windows extends further in the longitudinal direction of the tube than an adjacent one of the plurality of the windows.

13. The heat exchanger according to claim 12, wherein at least one of the windows includes a tabbed portion of the partitioning wall bent to extend into the first flow channel or the second flow channel.

14. The heat exchanger according to claim 12, further comprising a second header tank having a second tube opening formed therein, wherein a second end portion of the tube is received in the second header tank through the second tube opening, wherein a second one of the windows is disposed in alignment with a surface of the second header tank defining the second tube opening with respect to the longitudinal direction of the tube.

15. A method of forming a tube for a heat exchanger comprising the steps of:

providing a sheet of material;

removing a portion of the sheet to form a first opening from a first portion of the sheet, wherein a portion of a perimeter of the first opening defines a first tabbed portion of the sheet;

bending the first tabbed portion of the sheet about a first pivot portion connecting the first tabbed portion to the first portion of the sheet;

removing a portion of the sheet to form a second opening from a second portion of the sheet; and bending the sheet into a tubular shape, wherein the second portion of the sheet cooperates with the first portion of the sheet to form a partitioning wall dividing a hollow interior of the tube into a first flow channel and a second flow channel, wherein the first opening and the second opening cooperate to form a plurality of windows spaced from each other in a longitudinal direction of the tube and provide fluid communication between the first flow channel and the second flow channel, wherein a first one of the plurality of windows which is disposed proximate to an end of the tube extends further in the longitudinal direction of the tube than an adjacent one of the plurality of the windows.

16. The method according to claim 15, wherein the first tabbed portion is disposed at an acute angle with respect to the first portion of the sheet following the bending of the first tabbed portion about the first pivot portion thereof.

17. The method according to claim 15, wherein a portion of a perimeter of the second opening defines a second tabbed portion of the sheet, wherein the second tabbed portion of the sheet is bent about a second pivot portion connecting the second tabbed portion to the second portion of the sheet.

18. The method according to claim 15, wherein an entirety of a perimeter of the second opening defines a through-hole through the sheet.

* * * * *